US005795234A

United States Patent [19]

Inada et al.

[11] Patent Number: 5,795,234

[45] Date of Patent: Aug. 18, 1998

[54] PROCESS FOR FORMING BOLT

[75] Inventors: Takeshi Inada, Tokai; Munechika Nakane, Toyota, both of Japan

[73] Assignee: Toyota Jidosha Kabushiki Kaisha, Toyota, Japan

[21] Appl. No.: 694,612

[22] Filed: Aug. 13, 1996

[30] Foreign Application Priority Data

Aug. 17, 1995 [JP] Japan ..... 7-209461

[51] Int. Cl.[6] ..... B21H 3/02

[52] U.S. Cl. ..... 470/16; 470/11; 470/141; 470/152; 470/153; 72/334

[58] Field of Search ..... 72/334, 340, 344, 72/345, 357; 470/8, 11, 12, 16, 57, 86, 141, 143, 152, 153

[56] References Cited

U.S. PATENT DOCUMENTS

| | | | |
|---|---|---|---|
| 2,813,279 | 11/1957 | Friedman | 470/8 |
| 3,364,564 | 1/1968 | Kurtz et al. . | |
| 4,214,333 | 7/1980 | Kin | 72/325 |
| 4,932,234 | 6/1990 | Adachi . | |
| 5,456,100 | 10/1995 | Loomis | 72/344 |
| 5,542,276 | 8/1996 | Nielson et al. | 72/344 |
| 5,626,522 | 5/1997 | Nielson | 470/141 |

FOREIGN PATENT DOCUMENTS

| | | | |
|---|---|---|---|
| 28-37-996-A1 | 3/1980 | Germany . | |
| 56-105842 | 8/1981 | Japan | 470/8 |
| A-6-504116 | 5/1994 | Japan . | |
| WO 93/17810 | 9/1993 | WIPO . | |

*Primary Examiner*—Lowell A. Larson
*Assistant Examiner*—Ed Tolan
*Attorney, Agent, or Firm*—Oliff & Berridge, PLC

[57] ABSTRACT

In a process for forming a bolt, a die, a rod-shaped knock-out member, and a punch are prepared. The die has opposite end surfaces, a through bore opened to one of the opposite end surfaces, and a space connected with the through bore and disposed substantially perpendicular to an axial line of the through bore. The knock-out member is disposed in the through bore. The punch is disposed so as to face one of the opposite end surfaces of the die to which the through bore is opened. A bolt precursor is fitted into the through bore of the die at the leg member, and is pressed by the punch at the head member. The leading end of the leg member is pressed by the knock-out member, and accordingly an excess material of the bolt precursor at around the leading end of the leg member, or an excess material thereof adjacent to the leading end of the leg member is deformed and flowed into the space of the die as a thinned-out portion. Thus, the bolt precursor can be flattened at the leading-end surface of the leg member. The thinned-out portion can be removed by being held between the knock-out member and the die, and does not adversely affect the configuration of a completed bolt.

13 Claims, 5 Drawing Sheets

PROCESS FOR FORMING BOLT

BACKGROUND OF THE INVENTION

1. Field of the Invention

The present invention relates to a process for forming a bolt. In particular, it relates to a process for forming a bolt whose leg member has a flat leading-end surface.

2. Description of Related Art

Considering accuracy and readiness, the measurement of bolt-tightening force is carried out, for example, by using an ultrasonic axial-force meter as disclosed in Japanese-National-Law Laid-Open Patent Publication No. 6-504,116. In the measurement set forth in the Publication, a bolt is required to have a leg member whose leading-end surface is flat so that ultrasonic does not reflect irregularly at the leading-end of the bolt.

Bolts have been manufactured by using, for instance, a bolt-forming apparatus 1 as illustrated in FIG. 5. Note that the left-hand-side half of FIG. 5 illustrates before starting a bolt formation, and that the right-hand-side half thereof illustrates immediately after completing the bolt formation.

As illustrated in FIG. 5, the bolt-forming apparatus 1 is provided with a die 2, a rod-shaped knock-out member 3, and a punch 4. The die 2 has a through bore 2*a* for forming a leg member of a completed bolt 5, and the through bore 2*a* is opened to one of the opposite-end surfaces of the die 2. The knock-out member 3 is fitted into the through bore 2*a* of the die 2, and is disposed next to the leading end of the through bore 2*a*. The punch 4 faces the opposite end of the die 2 to which the through bore 2*a* is opened, and is disposed coaxially with the through bore 2*a*. The through bore 2*a* is reduced diametrically in proximity to the opening so as to constitute a drawing land 2*b*, and is further provided with a chamfering land 2*c* where the leading end of the knock-out member 3 is positioned.

As illustrated FIGS. 7 (*a*) and 7 (*b*), a cut iron workpiece 5*a* is machined to a bolt precursor 5*b*: namely; a cut iron workpiece 5*a* is further cut to a predetermined length, and is machined on the outer peripheral surface. The thus pre-formed bolt precursor 5*b* is fitted into the through bore 2*a* of the die 2, and is pressed by the punch 4 at the trailing end. As a result, the bolt precursor 5*b* is drawn by the land 2*b* of the die 2, and is thereby chamfered by the chamfering land 2*c* at the leading end of the leg member. Whilst, as illustrated in FIG. 7 (*c*), a head member is formed at the trailing end of the bolt precursor 5*b* by the punch 4 and the end surface of the die 2. After completing the processing, the punch 4 is retracted, and the knock-out member 3 is ascended in the through bore 2*a* so as to take a completed bolt 5*c* (shown in FIG. 7 (*c*)) out of the bolt-forming apparatus 1. Thereafter, as illustrated in FIGS. 7 (*d*) and 7 (*e*), the head member of the completed bolt 5*c* is processed hexagonally, or a flange member thereof is trimmed roundedly, if required. Eventually, a thread is formed on the leg member of the completed bolt 5*c* by rolling.

As illustrated in FIG. 6 (*a*), the outer peripheral surface of the cut iron workpiece 5*a* is an irregular surface, because it is formed by shearing or cutting. On the other hand, in accordance with the above-described bolt-forming process, the head member of the completed 5*c* has a flat surface, because the punch 4 applies such a large load to the trailing end of the bolt precursor 5*b* that the leading-end surface of the punch 4 is likely to be imprinted onto the trailing end of the bolt precursor 5*b*. However, the leading end of the leg member of the bolt precursor 5*b* is placed in an enclosed space which is surrounded by the chamfering land 2*c* of the die 2 and the knock-out member 3. Accordingly, the excess material of the bolt precursor 5*b* is inhibited from flowing. Moreover, due to the influences of the drawing rate for drawing the leg member of the bolt precursor 5*b*, and due to the chamfering to the leading end of the leg member thereof, the leading end of the leg member of the completed bolt 5*c* is likely to be uneven in radial directions as illustrated in FIGS. 6 (*b*) and 6 (*c*). As a result, the inherent irregular surface at the leading end of the completed bolt 5*c* cannot be corrected to a flat surface. Hence, in order to use an ultrasonic axial-force meter being convenient for measuring the bolt-tightening force, the leading end of the completed bolt 5*c* must be further machined to a flat surface. Thus, an extra processing is required, and accordingly pushes up the manufacturing cost of bolts.

SUMMARY OF THE INVENTION

The present invention has been developed in order to solve the aforementioned problems of conventional bolt-forming processes. It is therefore an object of the present invention to provide a process for forming a bolt which enables to securely give flatness to the leading-end surface of the leg member of bolts at a reduced cost.

An embodiment of the present invention can carry out the object, and comprises the steps of:

preparing a die, a rod-shaped knock-out member, and a punch, the die having opposite end surfaces, a through bore opened to one of the opposite end surfaces, and a space connected with the through bore and disposed substantially perpendicular to an axial line of the through bore, the knock-out member disposed in the through bore, the punch disposed so as to face one of the opposite end surfaces of the die to which the through bore is opened;

fitting a bolt precursor in to the through bore of the die, the bolt precursor including a leg member having a leading end and a trailing end; and pressing the bolt precursor by the punch so as to deform and flow a portion of the bolt precursor at around the leading end of the leg member, or a portion of the bolt precursor adjacent to the leading end of the leg member, the leading end of the leg member being pressed by the knock-out member, into the space of the die, thereby producing a thinned-out portion and flattening a leading-end surface of the leg member of the bolt precursor.

In accordance with the thus arranged embodiment of the present invention, after the leg member of the bolt precursor is pressed by the knock-out member at the leading end in the course of the formation of a leg member of a completed bolt, the portion of the bolt precursor at around the leading end of the leg member, or the portion of the bolt precursor adjacent to the leading end of the leg member deforms and flows into the space of the die which is connected with the through bore of the die. Thus, the thinned-out portion is produced around the leg member of the bolt precursor. Moreover, when the portion of the bolt precursor deforms and flows, an excess material of the bolt precursor fills a space between the leading end of the leg member and the end surface of the knock-out member. Accordingly, the leg member is provided with a flat surface at the leading end.

As a result, it is possible to measure a tightening force of a completed bolt with an ultrasonic meter without processing the leading-end surface of a completed bolt. At the same time, the manufacturing cost of a completed bolt can be reduced by obviating the leading-end-surface processing.

Moreover, in accordance with the embodiment of the present invention, the leg member of a complete bolt is filled up densely, and accordingly a volume of the leg member can be further stabilized so that a weight of completed bolts can be little fluctuated. In addition, the die is not constructed in an enclosed manner, but has the space which can be utilized to discharge the thinned-out portion as flashes. Therefore, it is possible to stabilize a bolt-forming load, and to decrease the elastic deformation of the knock-out member caused by the load. Accordingly, it is possible to prolong the life of the knock-out member.

Note that threads can be further formed on the leg-member of a completed bolt by ordinary rolling.

BRIEF DESCRIPTION OF THE DRAWINGS

A more complete appreciation of the present invention and many of its advantages will be readily obtained as the same becomes better understood by reference to the following detailed description when considered in connection with the accompanying drawings and detailed specification, all of which forms a part of the disclosure:

FIG. 6 (*b*) is a diagram for schematically illustrating a shape of a leading-end surface of a leg member of a completed bolt which is prepared by the conventional bolt-forming process;

FIG. 6 (*c*) is a diagram for schematically illustrating another shape of a leading-end surface of a leg member of a completed bolt which is prepared by the conventional bolt-forming process;

FIG. 7 schematically illustrates the steps of the conventional bolt-forming process, in which:

FIG. 7 (*a*) illustrates a cut-workpiece preparing step;

FIG. 7 (*b*) illustrates a preliminary leg-member-and-head-member forming step;

FIG. 7 (*c*) illustrates an actual leg-member-and-head-member forming step;

FIG. 7 (*d*) illustrates a head-member hexagonally-shaping step; and

FIG. 7 (*e*) illustrates a flange-member roundedly-trimming step; and

DETAILED DESCRIPTION OF THE PREFERRED EMBODIMENTS

Having generally described the present invention, a further understanding can be obtained by reference to the specific preferred embodiments which are provided herein for the purpose of illustration only and not intended to limit the scope of the appended claims.

The specific preferred embodiments will be hereinafter described with reference to the accompanying drawings.

First Preferred Embodiment

Figure 1:
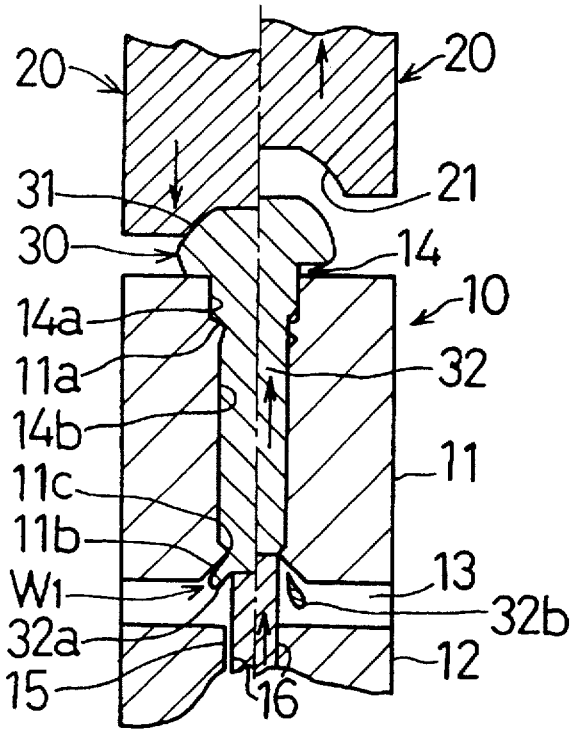
FIG. 1 schematically illustrates the steps of a First Preferred Embodiment according to the present bolt-forming process in cross-section, the left-hand-side half illustrates the extrusion-forming of a leg member of a bolt precursor and the press-forming of a head member thereof in operation, and the right-hand-side half illustrates the extrusion-forming and press-forming after completion.

FIG. 1 schematically illustrates the steps of a First Preferred Embodiment according to the present bolt-forming process in cross-section. The left-hand-side half illustrates the extrusion-forming of a leg member of a bolt precursor and the press-forming of a head member thereof in operation. The right-hand-side half illustrates the extrusion-forming and press-forming after completion.

As illustrated in FIG. 1, a die 10 includes a three-dimensionally-shaped upper die 11, and a three-dimensionally-shaped lower die 12. The upper and lower dies 11, 12 are constructed integrally by way of a space 13 therebetween. The upper die 11 is provided with a through bore 14 at the center. The through bore 14 is for forming a leg member of a completed bolt, and is reduced diametrically on a slightly inner side with respect to the top-end surface of the upper die 11. Specifically, the through bore 14 is reduced diametrically so as to conform to diameters of a completed bolt, and includes a through bore 14*a*, and a through bore 14*b*, which are arranged coaxially in two stages. At the boundary between the through bores 14*a* and 14*b*, there is disposed a drawing land 11*a* which extends in a slightly inclined manner with respect to the axial direction. On the other opposite end of the through bore 14*b*, there is disposed a cone-shaped concave 11*b* in the bottom-end surface of the upper die 11. At the inner end of the concave 11*b*, there is disposed a flange-shaped chamfer-drawing land 11*c*. The chamfer-drawing land 11*c* projects radially to the axial center, and includes surfaces which are inclined by about 45 deg. downward and upward, respectively.

The lower die 12 includes a through bore 15 which is disposed at a coaxial position with respect to the through bore 14 of the upper die 11. A rod-shaped knock-out member 16 is fitted into the through bore 15, and is urged by a spring (not shown). Thus, the knock-out member 16 can move vertically in the axial direction of the through bore 15. As illustrated in the left-hand-side half of FIG. 1, the top end of the knock-out member 16 is positioned substantially at the lower end of the upper die 11 when the knock-out member 16 is fully descended. As illustrated in the right-hand-side half of FIG. 1, the top end of the knock-out member 16 is positioned slightly above the inner end of the chamfer-drawing land 11 of the upper die 11 when the knock-out member 16 is fully ascended.

The punch 20 includes a concave 21 which conforms to the configuration of a head member of a completed bolt. The concave 21 is disposed in the lower-end surface of the punch 20, and is opened about the center thereof. The punch 20 is disposed so as to face the die 10 with its axial line superimposed on the axial line of the through bore 14 of the upper die 10. The punch 20 is installed to a pressing apparatus (not shown) so that it can reciprocate in the axial direction.

The operations of the thus arranged First Preferred Embodiment will be hereinafter described.

First of all, a bolt precursor 30 is fitted into the through bore 14*a* of the die 10. The bolt precursor 30 includes a preliminary-shaped head member 31. Then, the punch 20 is descended. Accordingly, the bolt precursor 30 is pressed at the head member 31 by the punch 20, and is drawn into the through bore 14*b* by the drawing land 11a. Thus, a leg member 32 of a completed bolt 30 is formed.

Moreover, the leg member 32 is pressed by the punch 20. Accordingly, the leg member 32 is chamfered at the leading end by the chamfer-drawing land 11*c*, and is pressed onto the knock-out member 16. When the knock-out member 16 is fully descended, there is formed a clearance W1 between the concave 11*b* of the upper die 11 and the top end of the knock-out member 16. Note that the clearance W1 communicates the through bore 14*b* with the space 13. The clearance W1 enables the excess material of the bolt precursor 30 to deform and flow at the leading end of the leg member 32. Hence, the excess material flows into the space 13 through the clearance W1, and forms a flange-shaped thinned-out portion 32*a* around the leading end of the leg member 32. The deforming and flowing of the excess material fills between the leading end of the leg member 32 and the top-end surface of the knock-out member 16. As a result, the leading end of the leg member 32 is turned into a flat surface.

Thereafter, the pressing by the punch 20 is canceled to separate the punch 20 from the die 10 upward as illustrated in the right-hand-side half of FIG. 1. Accordingly, the knock-out member 16 is moved upward to push a completed bolt 30. As a result, the thinned-out portion 32*a*, disposed at the leading end of the leg member 32, is held between the chamfer-drawing land 11*c* and the knock-out member 16, and is removed as flashes 32*b*. Thus, the thinned-out portion 32*a* does not adversely affect the configuration of a completed bolt.

As having been described so far, simultaneously with the bolt-forming, the leading end of the leg member 32 of the bolt precursor 30 is turned into a flat surface in accordance with the First Preferred Embodiment. Therefore, the resulting bolt can be examined for the tightening force by using an ultrasonic axial-force meter, without ever processing the leading-end surface. The obviation of the leading-end-surface processing results in the reduction of the bolt-manufacturing cost. Moreover, the material is filled densely in the leg member 32 of a completed bolt 30, and consequently the volume of the leg member 32 is furthermore stabilized. Hence, the weight of completed bolts can be less likely to fluctuate. In addition, the die 10 is not constructed in an enclosed manner, but has the space 13 which can be utilized to discharge the thinned-out portion 32*a* as flashes. Therefore, the bolt-forming load can be stabilized, and thereby the elastic deformation of the knock-out member 16, caused by the load, can be decreased. Accordingly, the life of the knock-out member 16 can be prolonged.

Note that, in the First Preferred Embodiment, the drawing and the chamfering can be carried out independently. Moreover, the head-member shaping can be carried out in advance. However, in order to subsequently carry out the leg-member drawing, it is necessary that the volume of the portion to be a leg member be larger than the volume of the through bore 14 of the upper die 11.

Second Preferred Embodiment

Figure 2:
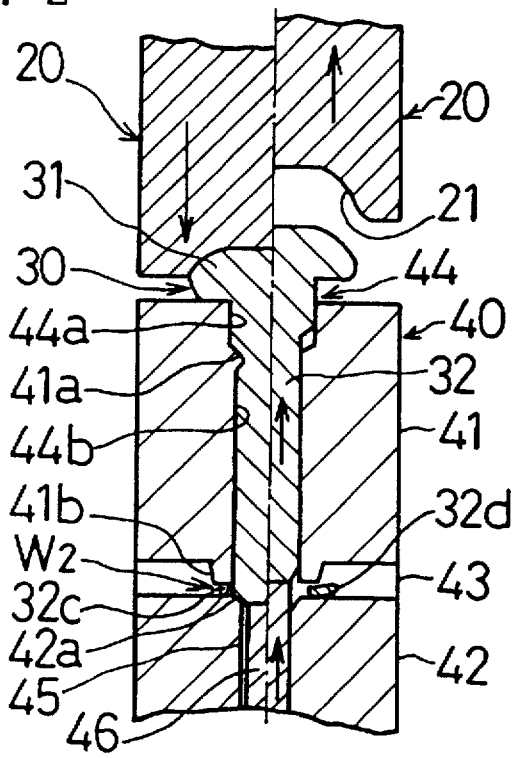
FIG. 2 schematically illustrates the steps of a Second Preferred Embodiment according to the present bolt-forming process in cross-section, the left-hand-side half illustrates the extrusion-forming of a leg member of a bolt precursor and the press-forming of a head member thereof in operation, and the right-hand-side half illustrates the extrusion-forming and press-forming after completion.

FIG. 2 schematically illustrates the steps of a Second Preferred Embodiment according to the present bolt-forming process in cross-section. The left-hand-side half illustrates the extrusion-forming of a leg member of a bolt precursor and the press-forming of a head member thereof in operation. The right-band-side half illustrates the extrusion-forming and press-forming after completion.

As illustrated in FIG. 2, a die 40 includes a three-dimensionally-shaped upper die 41, and a three-dimensionally-shaped lower die 42. The upper and lower dies 41, 42 are constructed integrally by way of a space 43 therebetween. The upper die 41 is provided with a through bore 44 at the center. The through bore 44 is for forming a leg member of a completed bolt, and is reduced diametrically on a slightly inner side with respect to the top-end surface of the upper die 41. Specifically, the through bore 44 is reduced diametrically so as to conform to diameters of a completed bolt, and includes a through bore 44*a*, and a through bore 44*b*, which are arranged coaxially in two stages. At the boundary between the through bores 44*a* and 44*b*, there is disposed a drawing land 41*a* which extends in a slightly inclined manner with respect to the axial direction. In the Second Preferred Embodiment, note that the space 43 communicates with the through bore 44*b* by way of a clearance W2 having a minute width, and that a ring-shaped projection 41*b* is disposed around the through bore 44*b* on the bottom-end surface of the upper die 41.

The lower die 42 includes a through bore 45 which is disposed at a coaxial position with respect to the through bore 44 of the upper die 41. Moreover, the lower die 42 includes a chamfering drawer 42*a* around the through bore 45 in the top-end surface. The chamfering drawer 42*a* is cut-off by 30 deg. with respect to the top-end surface of the lower die 42. A rod-shaped knock-out member 46 is fitted into the through bore 45, and is urged by a spring (not shown). Thus, the knock-out member 46 can move vertically in the axial direction of the through bore 45. As illustrated in the left-hand-side half of FIG. 2, the top end of the knock-out member 46 is positioned substantially at the lower end of the chamfering drawer 42*a* when the knock-out member 46 is fully descended. As illustrated in the right-hand-side half of FIG. 2, the top end of the knock-out member 46 is positioned substantially at the lower end of the projection 41*b* when the knock-out member 46 is fully ascended.

The punch 20 has the same construction as that of the First Preferred Embodiment, and will be hereinafter described by designating the same reference number.

The operations of the thus arranged Second Preferred Embodiment will be hereinafter described.

First of all, a bolt precursor 30 is fitted into the through bore 44*a* of the die 40. The bolt precursor 30 includes a preliminary-shaped head m ember 31. Then, the punch 20 is descended. Accordingly, the bolt precursor 30 is pressed at the head member 31 by the press 20, and is drawn into the through bore 44*b* by the drawing land 41*a*. Thus, a leg member 32 of a completed bolt 30 is formed. Moreover, when being pressed by the punch 20, the leg member 32 is pressed against the knock-out member 46 at the leading end, and thereby the leading end is chamfered by the chamfering drawer 42*a* of the lower die 42.

When the knock-out member 46 is fully descended, there is formed the clearance W2 between the bottom-end surface of the projection 41*b* of the upper die 41 and the top-end surface of the lower die 42. The clearance W2 enables the excess material of the bolt precursor 30 to radially deform and flow at the leading end of the leg member 32. Hence, the excess material flows into the clearance W2, and forms a flange-shaped thinned-out portion 32*c* around the leg member 32. The deforming and flowing of the excess material plasticizes the leg member 32 at the leading end, and thereby the excess material fills between the bottom-end surface of the projection 41*b* of the upper die 41 and the top-end surface of the lower die 42. Thus, the knock-out member 46 can be kept pressing the leading end of the leg member 32. As a result, the leading end of the leg member 32 is turned into a flat surface.

Thereafter, the pressing by the punch 20 is canceled to separate the punch 20 from the die 40 upward as illustrated in the right-hand-side half of FIG. 2. Accordingly, the knock-out member 46 is moved upward to push a completed bolt 30. As a result, the thinned-out portion 32*c*, disposed adjacent to the leading end of the leg member 32, is held between the projection 41*b* and the knock-out member 46, and is removed as flashes 32*d*. Thus, the thinned-out portion 32*c* does not adversely affect the configuration of a completed bolt.

As having been described so far, in a manner similar to the First Preferred Embodiment, the Second Preferred Embodiment enables to examine the resulting bolt for the tightening force by using an ultrasonic axial-force meter, without ever processing the leading-end surface. The obviation of the leading-end-surface processing results in the reduction of the bolt-manufacturing cost. Moreover, the weight of completed bolts can be less likely to fluctuate. In addition, the bolt-forming load can be stabilized, and accordingly the life of the knock-out member 46 can be prolonged.

Note that, also in the Second Preferred Embodiment, the drawing and the chamfering can be carried out independently. Moreover, the head-member shaping can be carried out in advance. However, in order to subsequently carry out the leg-member drawing, it is necessary that the volume of the portion to be a leg-member be larger than the volume of the through bore 44 of the upper die 41.

Third Preferred Embodiment

Figure 3:
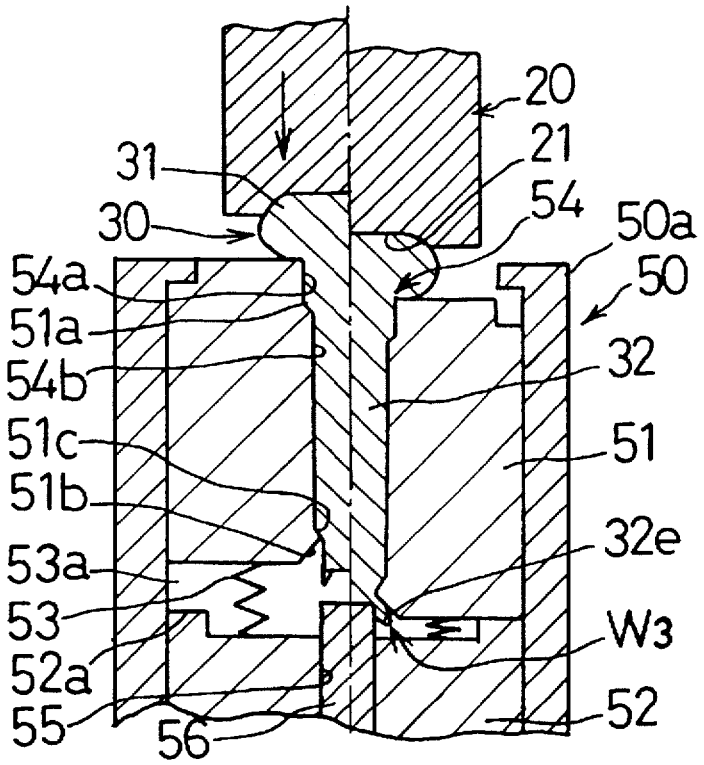
FIG. 3 schematically illustrates the steps of a Third Preferred Embodiment according to the present bolt-forming process in cross-section, the left-hand-side half illustrates a state before processing a bolt precursor, and the right-hand-side half illustrates the processing in operation.

A Third Preferred Embodiment according to the present bolt-forming process employs a preliminary-processed bolt precursor 30. For example, a leg member 32 of the bolt precursor 30 has been approximated to a configuration of a through bore of a die by preliminarily processing a cut workpiece, and a head member 31 thereof has also been shaped to a predetermined shape by preliminarily processing a cut workpiece. FIG. 3 schematically illustrates the steps of the Third Preferred Embodiment in cross-section. The left-hand-side half illustrates a state beforeprocessing the bolt precursor 30, and the right-hand-side half illustrates the processing in operation.

As illustrated in FIG. 3, a die 50 includes a three-dimensionally-shaped upper die 51, and a three-dimensionally-shaped lower die 52. The upper and lower dies 51, 52 are accommodated in a three-dimensionally-shaped frame 50*a* so that they can move vertically in the drawing. Coiled springs 53 are disposed between the upper and lower dies 51, 52. Accordingly, the upper die 51 is usually pushed by the urging force of the coiled springs 53 up to the top end of the frame 50*a*. Thus, there is formed a space 53*a* between the upper die 51 and the lower die 52.

The upper die 51 has the virtually same configuration as that of the upper die 11 in the First Preferred Embodiment, and is also provided with a through bore 54 at the center The through bore 54 is for forming a leg member of a completed bolt, and is reduced diametrically on a slightly inner side with respect to the top-end surface of the upper die 51. Specifically, the through bore 54 is reduced diametrically so as to conform to diameters of a completed bolt, and includes a through bore 54*a*, and a through bore 54*b*, which are arranged coaxially in two stages. At the boundary between the through bores 54*a* and 54*b*, there is disposed a drawing land 51*a* which extends in a slightly inclined manner with respect to the axial direction. On the other opposite end of the through bore 54*b*, there is disposed a cone-shaped concave 51*b* in the bottom-end surface of the upper die 51. At the inner end of the concave 51*b*, there is disposed a flange-shaped chamfer-drawing land 51*c*. The chamfer-drawing land 51*c* projects radially to the axial center, and includes surfaces which are inclined by about 45 deg. downward and upward, respectively.

The lower die 52 includes a stopper 52*a* on the peripheral portion of the top-end surface. The stopper 52*a* defines the descending limit of the upper die 51, and forms a space between the bottom-end surface of the upper die 51 and the top-end surface of the lower die 52 excepting the stopper 52*a*. The lower die 52 also includes a through bore 55 which is disposed at a coaxial position with respect to the through bore 54 of the upper die 51. A rod-shaped knock-out member 56 is fitted into the through bore 55. The knock-out member 56 is fixed during the bolt-forming operation The top-end surface of the knock-out member 56 is substantially flush with the top-end surface of the stopper 52*a*. After the bolt-forming operation is completed, or after the upper die 51 is fully descended, the knock-out member 56 pushes up a completed bolt 30.

The punch 20 has the same construction as those of the First and Second Preferred Embodiments, and will be hereinafter described by designating the same reference number.

The operations of the thus arranged Third Preferred Embodiment will be hereinafter described.

First of all, a preliminary-processed bolt precursor 30 is fitted into the through bores 54*a*, 54*b* of the die 50. When the bolt precursor 30 is fitted thereinto, the leading end of the leg member 32 of the bolt precursor 30 slightly protrudes from the bottom-end surface of the upper die 51 into the space 53*a*. Then, the punch 20 is descended to push the head member 31 of the bolt precursor 30. Simultaneously, the upper die 52 is pushed by the punch 20 to descend. Accordingly, the bolt precursor 30 is pressed downward by the punch 20, and is pressed at leading end of the leg member 32 against the knock-out member 56.

When the upper die 51 is fully descended, there is formed a clearance W3 between the concave 51*b* of the upper die 51 and the top-end surface of the knock-out member 56. The clearance W3 enables the excess material of the bolt precursor 30 to deform and flow at the leading end of the leg member 32. Hence, the excess material flows into the space 53*a* through the clearance W3, and forms a flange-shaped thinned-out portion 32*e* around the leading end of the leg member 32. The deforming and flowing of the excess material fills between the leading end of the leg member 32 and the top-end surface of the knock-out member 56. As a result, the leading end of the leg member 32 is turned into a flat surface.

Thereafter, the pressing by the punch 20 is canceled to separate the punch 20 from the die 50 upward. Accordingly, the upper die 51 is ascended by the urging force of the coiled springs 53. Moreover, the knock-out member 56 is moved upward to push a completed bolt 30. As a result, the thinned-out portion 32*e*, disposed at the leading end of the leg member 32, is held between the chamfer-drawing land 51*c* of the upper die 51 and the knock-out member 56, and is removed as flashes knot shown). Thus, the thinned-out portion 32*e* does not adversely affect the configuration of a completed bolt.

As having been described so far, simultaneously with the bolt-forming, the leading end of the leg member 32 of the bolt precursor 30 is turned into a flat surface in accordance with the Third Preferred Embodiment. Therefore, the resulting completed bolt can be examined for the tightening force by using an ultrasonic axial-force meter, without ever processing the leading-end surface. At the same time, the obviation of the leading-end-surface processing results in the reduction of the bolt-manufacturing cost. In particular, in accordance with the Third Preferred Embodiment, the space 53*a* can be enlarged so that the leading-end surface of the leg member 32 can be flattened with higher accuracy. Likewise, in accordance with the Third Preferred Embodiment, the volume of completed bolts can be further stabilized, and thereby the weight thereof can be much less likely to fluctuate.

Fourth Preferred Embodiment

Figure 4:
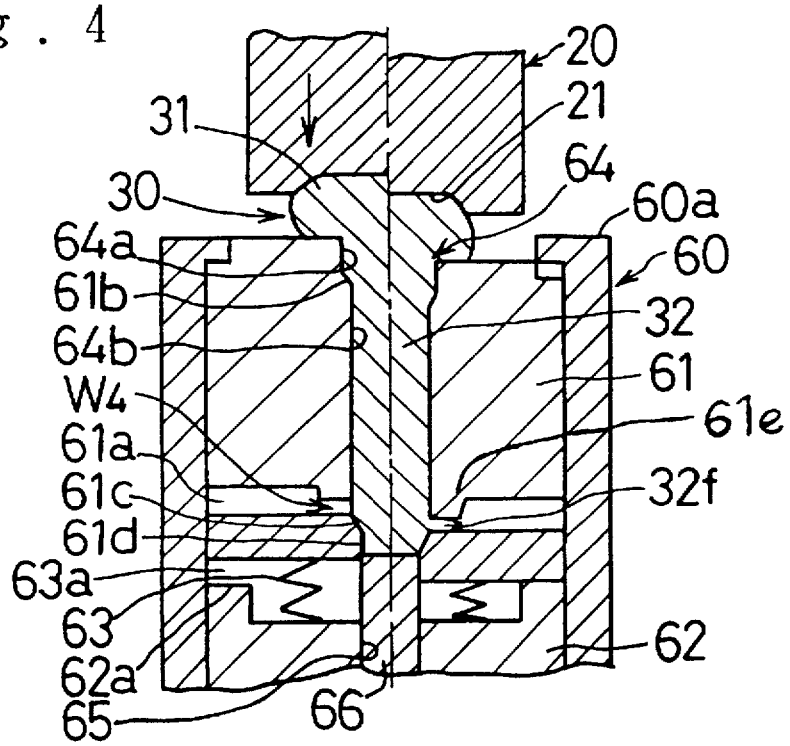
FIG. 4 schematically illustrates the steps of a Fourth Preferred Embodiment according to the present bolt-forming process in cross-section, the left-hand-side half illustrates a state before processing a bolt precursor, and the right-hand-side half illustrates the processing in operation.
Figure 5:
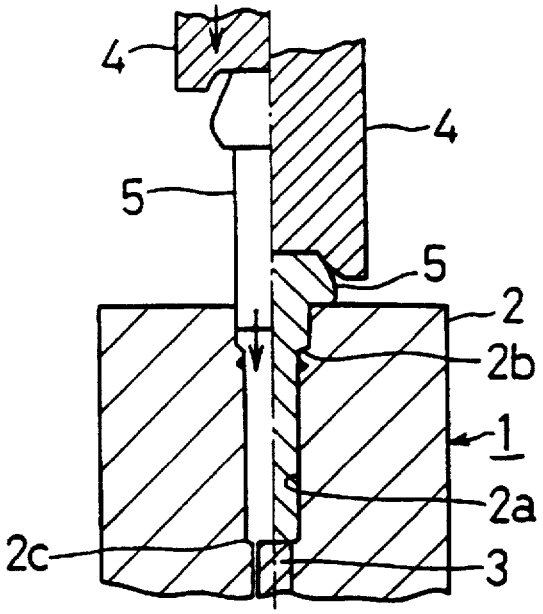
Fig. 5 ( PRIOR ART )
FIG. 5 schematically illustrates the steps of a conventional bolt-forming process in cross-section, the left-hand-side half illustrates a state before processing a bolt precursor, and the right-hand-side half illustrates the processing in operation.
Figure 6A:
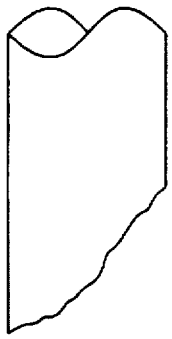
Fig. 6(a) (PRIOR ART)
FIG. 6 (*a*) is a diagram for schematically illustrating an outer peripheral surface of a cut iron workpiece for preparing a bolt precursor.
Figure 6B:
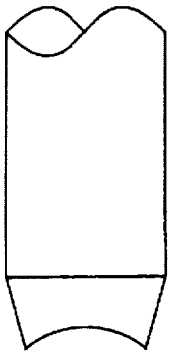
Fig. 6(b) (PRIOR ART)
Figure 6C:
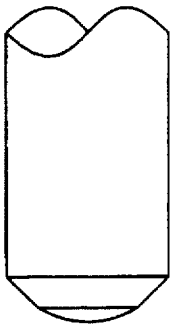
Fig. 6(c) (PRIOR ART)
Figure 7A:
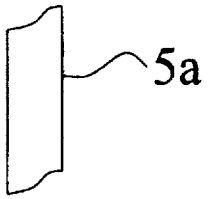
Fig. 7(a) (PRIOR ART)
Figure 7B:
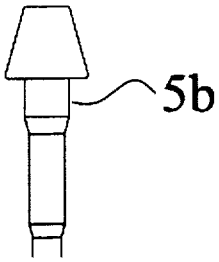
Fig. 7(b) (PRIOR ART)
Figure 7C:
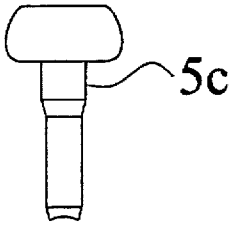
Fig. 7(c) (PRIOR ART)
Figure 7D:
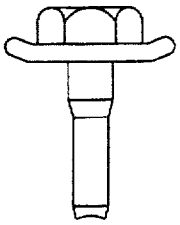
Fig. 7(d) (PRIOR ART)
Figure 7E:
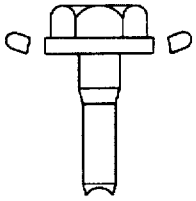
Fig. 7(e) (PRIOR ART)

Similarly to the Third Preferred Embodiment, a Fourth Preferred Embodiment according to the present bolt-forming process employs a preliminarily-processed bolt precursor 30. Likewise, a leg member 32 of the bolt precursor 30 has been approximated to a configuration of a through bore of a die by preliminarily processing a cut workpiece, and a head member 31 thereof has also been shaped to a predetermined shape by preliminarily processing a cut workpiece. FIG. 4 schematically illustrates the steps of the Fourth Preferred Embodiment in cross-section. The left-hand-side half illustrates a state before processing the bolt precursor 30, and the right-hand-side half illustrates the processing in operation.

As illustrated in FIG. 4, a die 60 includes a three-dimensionally-shaped upper die 61, and a three-dimensionally-shaped lower die 62. The upper and lower dies 61, 62 are accommodated in a three-dimensionally-shaped frame 60*a* so that they can move vertically in the drawing. Coiled springs 63 are disposed between the upper and lower dies 61, 62. Accordingly, the upper die 61 is usually pushed by the urging force of the coiled springs 63 up to the top end of the frame 62*a*. Thus, there is formed a space 63*a* between the upper die 61 and the lower die 62.

The upper die 61 is provided with a through bore 64 at the center. The through bore 64 is for forming a leg member of a completed bolt, and is reduced diametrically on a slightly inner side with respect to the top-end surface of the upper die 61. Specifically, the through bore 64 is reduced diametrically so as to conform to diameters of a completed bolt, and includes a through bore 64*a*, and a through bore 64*b*, which are arranged coaxially in two stages. At the boundary between the through bores 64*a* and 64*b*, there is disposed a drawing land 61*b* which extends in a slightly inclined manner with respect to the axial direction.

Figure 8:
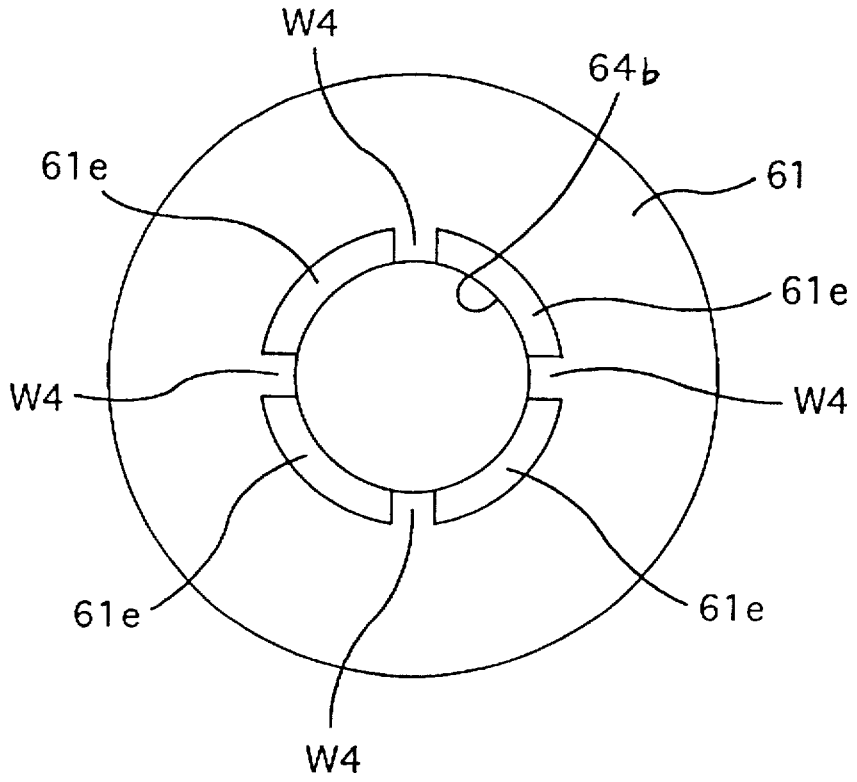
FIG. 8 schematically illustrates an internal bottom-end surface of an upper die which is employed by the Fourth Preferred Embodiment depicted in FIG. 4.

Moreover, in the Fourth Preferred Embodiment, note that the upper die 61 is provided with a space 61*a* therein. The space 61*a* is disposed adjacent to the bottom end of the upper die 61, and extends parallel to the bottom-end surface thereof. Under the space 61*a*, there is disposed a chamfering land 61*c* which extends in a slightly inclined manner with respect to the axial direction. The chamfering land 61*c* is reduced diametrically at the lower end 61*d* so that it has a slightly smaller diameter than that of the through bore 64*b*. Note that the space 61*a* includes a ring-shaped clearance W4 which communicates with the through bore 64*b*, which surrounds the through bore 64*b*, and which has a width smaller than the width of the other parts of the space 61*a*. In addition, as illustrated in FIG. 8, the clearance W4 is divided into four sections in the circumferential direction by axially-projected walls 61*e* which extend in the axial direction.

The lower die 62 includes a stopper 62*a* on the peripheral portion of the top-end surface. The stopper 62*a* defines the descending limit of the upper die 61, and forms the space 63*a* between the bottom-end surface of the upper die 61 and the top-end surface of the lower die 62 excepting the stopper 62*a*. The lower die 62 also includes a through bore 65 which is disposed at a coaxial position with respect to the through bore 64 of the upper die 61. A rod-shaped knock-out member 66 is fitted into the through bore 65.

The knock-out member 66 is fixed during the bolt-forming operation. The top-end surface of the knock-out member 66 is substantially flush with the bottom end of the upper die 61. After the bolt-forming operation is completed, or after the upper die 61 is fully descended, the knock-out member 66 pushes up a completed bolt 30.

The punch 20 has the same construction as those of the First, Second and Third Preferred Embodiments, and will be hereinafter described by designating the same reference number.

The operations of the thus arranged Fourth Preferred Embodiment will be hereinafter described.

First of all, a preliminary-processed bolt precursor 30 is fitted into the through bores 64*a*, 64*b* of the die 60. When the bolt precursor 30 is fitted thereinto, the leading end of the leg member 32 of the bolt precursor 30 contacts with the top-end surface of the knock-out member 66. Then, the punch 20 is descended to push the head member 31 of the bolt precursor 30. Simultaneously, the upper die 62 is pushed by the punch 20 to descend. Accordingly, the bolt precursor 30 is pressed downward by the punch 20, and is pressed at the leading end of the leg member 32 against the knock-out member 66.

When the upper die 61 is fully descended, the space 61*a* is positioned immediately above the chamfered leading end of the leg member 32 of the bolt precursor 30. Consequently, the excess material of the bolt precursor 30, resulting from the flow and deformation adjacent to the leading end of the leg member 32, flows into the space 61*a* by way of the ring-shaped clearance W4. Thus, a thinned-out portion 32*f* is formed adjacent to and around the leading end of the leg member 32, and is divided by the axially-projected walls 61*e* into four arc-shaped sections. The deforming and flowing of the excess material fills between the leading end of the leg member 32 and the top-end surface of the knock-out member 56. As a result, the leading end of the leg member 32 is turned into a flat surface.

Thereafter, the pressing by the punch 20 is canceled to separate the punch 20 from the die 60 upward. Accordingly, the upper die 61 is ascended by the urging force of the coiled springs 63. Moreover, the knock-out member 66 is moved upward to push a completed bolt 30. As a result, the thinned-out portion 32*f*, disposed adjacent to the leading end of the leg member 32, is held between the bottom end of the axially-projected walls 61*e* and the chamfering land 61*c*, and is removed as flashes (not shown). Thus, the thinned-out portion 32*f* does not adversely affect the configuration of a completed bolt. Hence, the Fourth Preferred Embodiment can effect advantages identical with those of the Third Preferred Embodiment.

In the Fourth Preferred Embodiment, the flashes can be readily removed via the space 61*a*, because they are divided equally into the four arc-shaped sections in the circumferential direction.

In the above-described specific preferred embodiments, the dies, the punches, and the knock-out members are disposed vertically. Note that, however, they can be disposed horizontally.

Having now fully described the present invention, it will be apparent to one of ordinary skill in the art that many changes and modifications can be made thereto without departing from the spirit or scope of the present invention as set forth herein including the appended claims.

What is claimed is:

1. A process for forming a bolt, the process comprising the steps of:

preparing a die, a rod-shaped knock-out member, and a punch, the die having opposite end surfaces, a through bore opened to one of the opposite end surfaces, and a space connected with the through bore and disposed substantially perpendicular to an axial line of the through bore, the knock-out member disposed in the through bore, the punch disposed so as to face one of the opposite end surfaces of the die to which the through bore is opened;

fitting a bolt precursor into the through bore of the die, the bolt precursor including a leg member having a leading end and a trailing end; and pressing the bolt precursor by the punch so as to deform and flow a portion of the bolt precursor at around the leading end of the leg member, or a portion of the bolt precursor adjacent to the leading end of the leg member, the leading end of the leg member being pressed by the knock-out member, into the space of the die, thereby producing a thinned-out portion and flattening a leading-end surface of the leg member of the bolt precursor.

2. The process according to claim 1, wherein the die is kept stationary in said pressing step, and the knock-out member is movable in the through bore of the die in said pressing step.

3. The process according to claim 1, wherein the die is movable in said pressing step, and the knock-out member is kept stationary in the through bore of the die in said pressing step.

4. The process according to claim 1, wherein the through bore of the die has a concave at one of the opposite ends which is connected with the space.

5. The process according to claim 4, wherein the concave has a flange-shaped land on the inner peripheral surface.

6. The process according to claim 1, wherein the die includes a first die, and a second die which involve the through bore, and which are constructed integrally by way of the space.

7. The process according to claim 6, wherein one of the first and second dies is movable in said pressing step, and the knock-out member is kept stationary in the through bore in said pressing step.

8. The process according to claim 7, wherein another one of the first and second dies has a stopper which defines a movable limit of the movable one of the first and second dies.

9. The process according to claim 6, wherein one of the first and second dies has the space therein.

10. The process according to claim 6, wherein one of the first and second dies has a projection which is connected to the through bore, and which projects into the space in the axial direction of the through bore.

11. The process according to claim 10, wherein the projection is divided into a plurality of sections.

12. The process according to claim 1, wherein the die includes a first die and a second die which involve the through bore, and which define the space therebetween.

13. A bolt-forming apparatus, comprising:

a die including a lower die portion and an upper die portion;

a rod-shaped knock-out member; and a punch;

the upper die having an opposite end surface and the lower die having an opposite end surface, a through bore opened to one of the opposite end surfaces, and a space defined by the lower die portion and the upper die portion and connected with the through bore and disposed substantially perpendicular to an axial line of the through bore, the upper die portion and the lower die portion being configured to produce a thinning region of material at the end of a bolt when the bolt is pressed into the space by the punch and the knock-out member;

the knock-out member disposed in the through bore; and the punch disposed so as to face one of the opposite end surfaces of the die to which the through bore is opened.

* * * * *